US009764225B1

(12) United States Patent
Munari

(10) Patent No.: US 9,764,225 B1
(45) Date of Patent: Sep. 19, 2017

(54) FORTUNE TELLING DEVICE, SYSTEM AND METHOD OF USING THE SAME

(71) Applicant: Geno Munari, Las Vegas, NV (US)

(72) Inventor: Geno Munari, Las Vegas, NV (US)

( * ) Notice: Subject to any disclaimer, the term of this patent is extended or adjusted under 35 U.S.C. 154(b) by 513 days.

(21) Appl. No.: 14/049,478

(22) Filed: Oct. 9, 2013

(51) Int. Cl.
*A63F 9/18* (2006.01)

(52) U.S. Cl.
CPC ..... *A63F 9/181* (2013.01)

(58) Field of Classification Search
CPC ..... G06F 7/08; A63F 9/181
USPC ..... 273/161
See application file for complete search history.

(56) References Cited

U.S. PATENT DOCUMENTS 4,193,213 A * 3/1980 Suda ..... A63F 9/181 273/161
5,479,529 A * 12/1995 Nakagawa ..... G06K 9/00268 273/161
5,636,839 A * 6/1997 Oda ..... A63F 9/181 273/161
6,523,039 B1 * 2/2003 Chen ..... G06Q 30/02
2011/0098108 A1 * 4/2011 Kuper ..... A63F 13/60 463/29
2015/0074205 A1 * 3/2015 Westphal ..... H04L 51/10 709/206

* cited by examiner

*Primary Examiner* — David L Lewis
*Assistant Examiner* — Shauna-Kay Hall
(74) *Attorney, Agent, or Firm* — FisherBroyles LLP; Rob L. Phillips

(57) ABSTRACT

An electronic, automated fortune telling device utilizing celebrity personalities to entertain users. A portable stand-alone unit including a cabinet housing a video display, bill validator, debit/credit card reader, user interface, processor, memory and speakers. The memory maintains one or more databases of celebrity video and audio files which are used to present the fortune telling routines to the user via the video display. A user is able to select a celebrity to present the fortune telling routine. The fortune telling device may also be configured to perform mock celebrity weddings after which the fortune telling device prints a wedding certificate and/or dispenses a pair of wedding bands and/or transmits a digital wedding photo.

18 Claims, 21 Drawing Sheets

405-4

505-4

505-8

FORTUNE TELLING DEVICE, SYSTEM AND METHOD OF USING THE SAME

FIELD OF THE INVENTION

The embodiments of the present invention relate to a fortune telling device and system configured to interact with a user via celebrity personalities.

BACKGROUND

Fortune telling is a well-known and well-liked entertainment endeavor. While most people understand that fortune telling is not real, most people still enjoy fortune telling as an entertainment premise. Live fortune telling is available but tends to be more than most people want from the experience. Heretofore, electronic, automated fortune telling devices have been lacking.

Accordingly, it would be beneficial to develop an electronic, automated fortune telling devices and systems which are exciting and attractive to users.

SUMMARY

The embodiments of the present invention are directed to an electronic, automated fortune telling device utilizing celebrity personalities to entertain users. In one embodiment, a portable standalone unit including a cabinet housing a video display, bill validator, debit/credit card reader, user interface, processor, printer, memory and speakers. The memory maintains one or more databases of celebrity video and audio clips which are used to present the fortune telling routines to the user via the video display. In one embodiment, a user is able to select a celebrity to present the fortune telling routine. In another embodiment, the celebrity presenting the fortune telling routine is randomly selected by the processor.

In another embodiment, the fortune telling device includes a printer for printing out fortunes or other information. For example, one embodiment of the device, a displayed celebrity conducts a mock wedding after which the fortune telling device prints a wedding certificate. In such an embodiment, the fortune telling device may include a storage compartment and dispenser for dispensing a pair of wedding bands for the users being fictitiously wed.

In another embodiment, the fortune telling routine is triggered when a sensor determines that a user is staring into the eyes of the celebrity personality. The sensor may be positioned proximate the video display to capture movements of a potential user such that pre-recorded attraction video and audio files may be played. In one embodiment, the sensor, along with video recognition software, can identify certain attributes of the user and quasi-customize the fortune telling routine by selecting specific fortune telling routines from a database of fortune telling routines.

Other variations, embodiments and features of the present invention will become evident from the following detailed description, drawings and claims.

DETAILED DESCRIPTION

Figure 1:
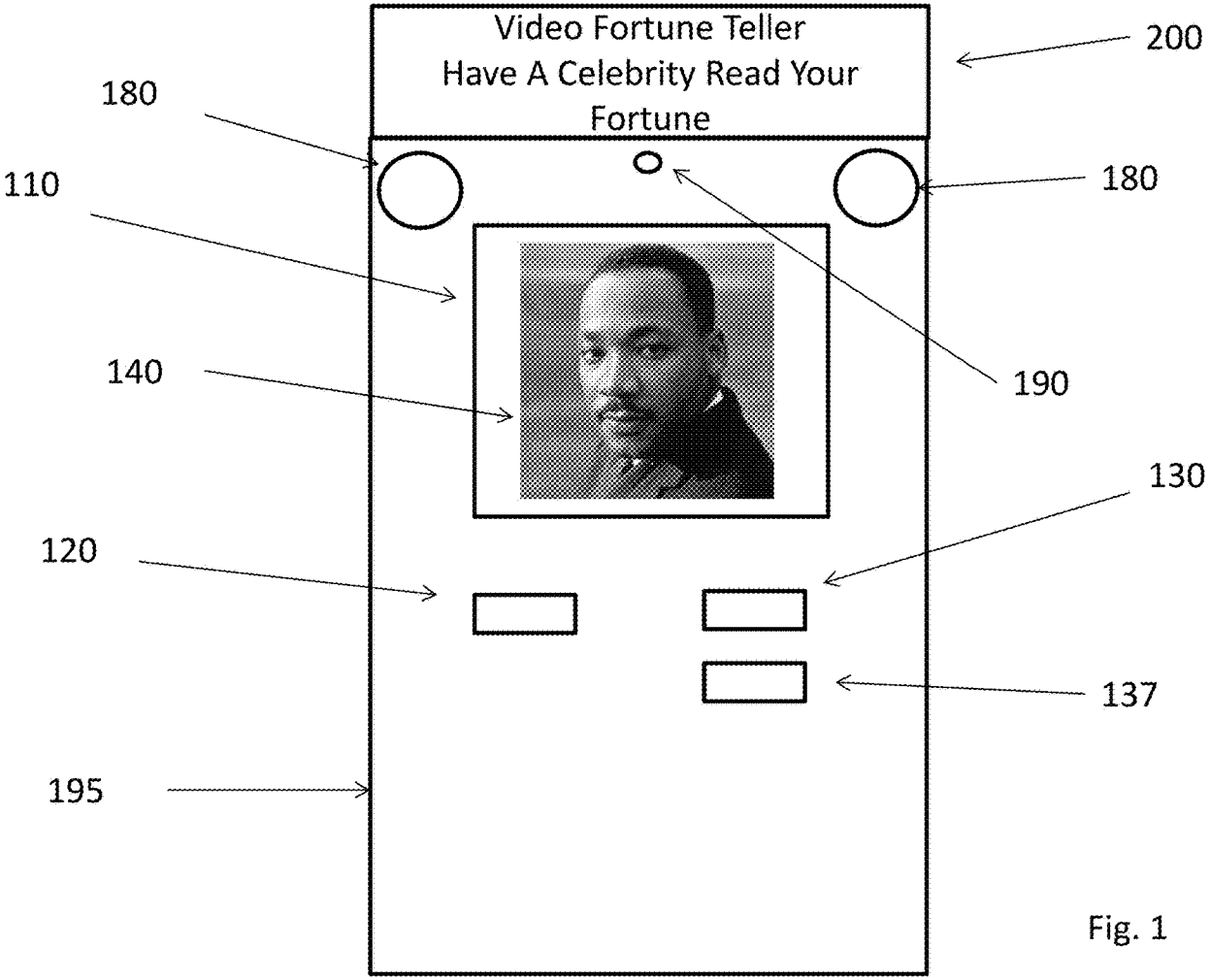
FIG. 1 illustrates a front view of a first exemplary fortune telling device according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "terminal" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

Figure 2:
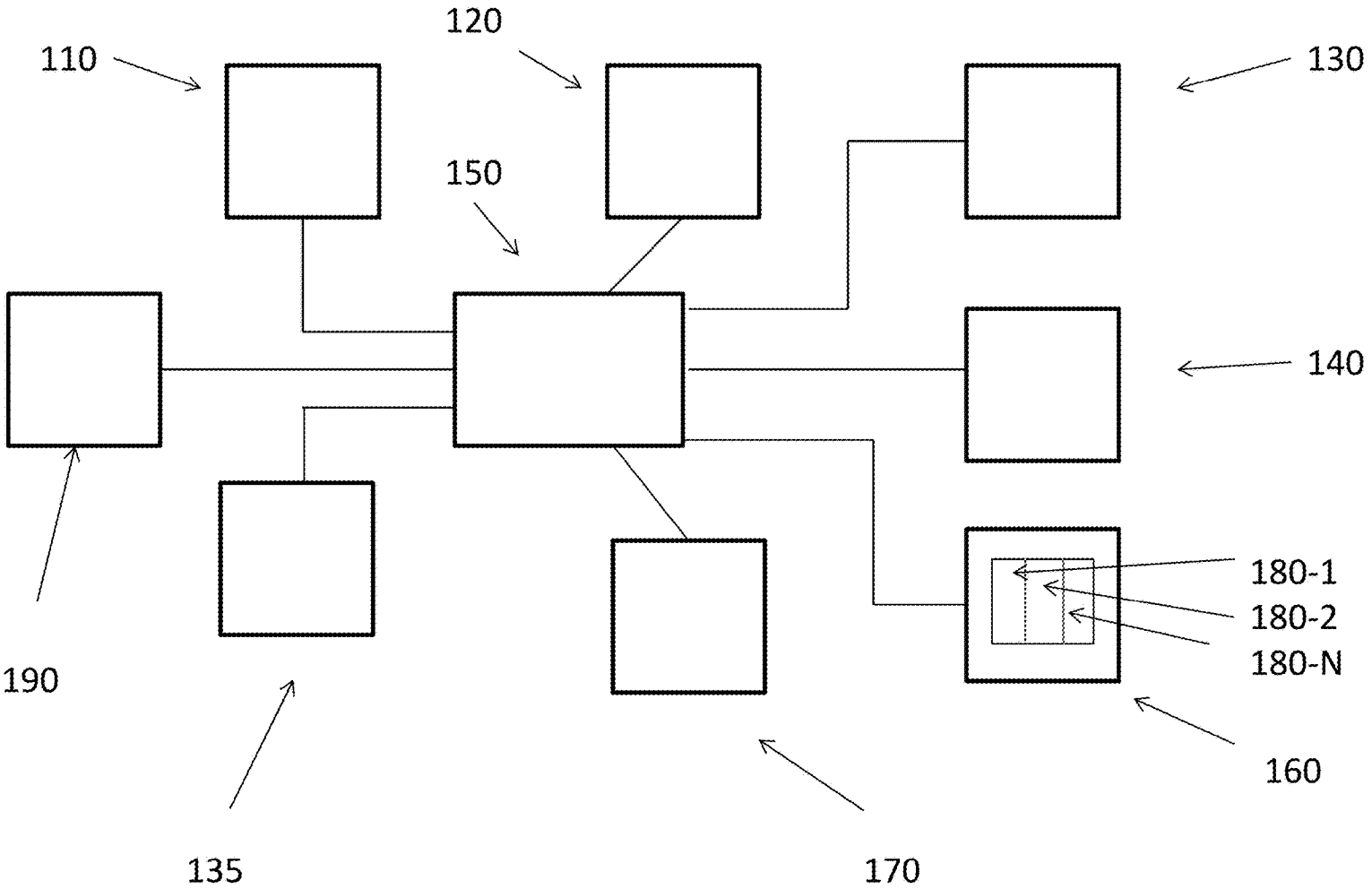
FIG. 2 illustrates a block diagram of a fortune telling device according to the embodiments of the present invention.

FIG. 2 shows a block diagram of a fortune telling device 100 according to the embodiments of the present invention. The fortune telling device 100 includes a video display 110, bill validator 120, debit/credit card reader 130, printer 135, user interface 140, processor 150, memory 160 and speakers 170. In one embodiment, the user interface 140 is a touch screen video display while in other embodiments the user interface may be a button panel, joystick, track ball or similar article. The memory 160 manages one or more databases 180-1 through 180-N. The one or more databases 180-1 through 180-N store celebrity video and audio files for reasons set forth below. The one or more databases 180-1 through 180-N may also store various music files, attract mode files and other video and audio files as set forth below. In one embodiment, a sensor 190 is positioned to capture a user's eyes or other movements which are used to trigger the fortune telling routine comprising a video and audio file.

As configured, the processor 150 is programmed with executable instructions to communicate with and/or manage and/or control the video display 110, bill validator 120, debit/credit card reader 130, user interface 140, speakers 170 and sensor 190 contained in housing 195.

FIG. 1 shows a front view of an exemplary fortune telling device 100 according to the embodiments of the present invention. The fortune telling device 100 includes the video display 110, bill validator 120, debit/card reader 130, user interface 140 (in this case a touch screen display), speakers 170 and sensor 190. A sign 200 is designed to attract users. Printer slot 137 in communication with the printer 135 discharges a printed keepsake memorializing the fortune telling experience.

Figure 3:
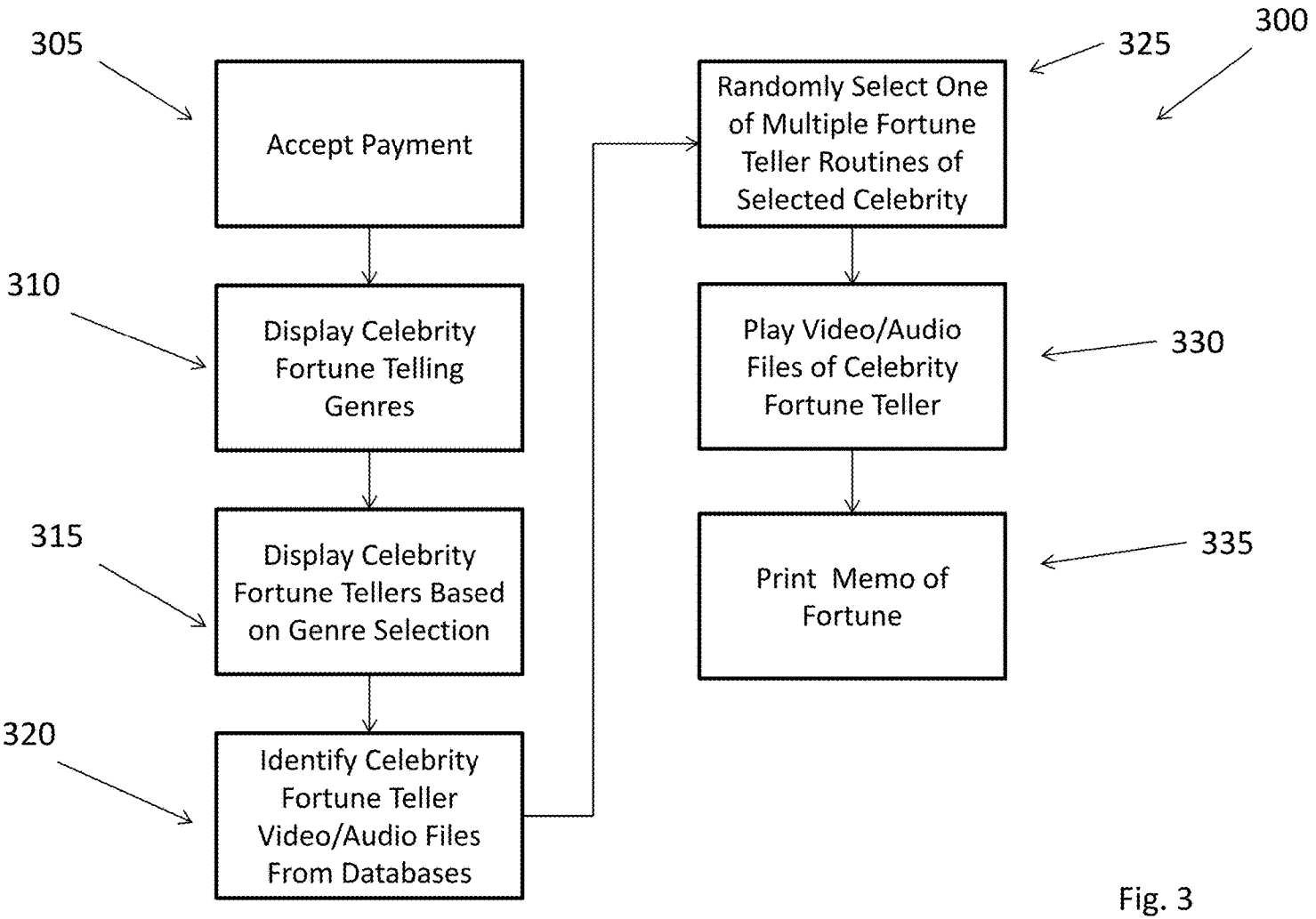
FIG. 3 illustrates a flow chart detailing one method of operating the fortune telling device according to the embodiments of the present invention.

FIG. 3 show a flow chart 300 and FIGS. 4A-4D show various, exemplary screen shots 405-1 through 405-4 which together provide a detailed outline of operating the video fortune telling device 100 according to the embodiments of the present invention. At 305, a user makes a payment which is accepted by the fortune telling device 100 to have his or her fortune told by a celebrity. The payment may be made by inserting currency or coupon into the bill validator 120 or using a debit/credit card inserted into the debit/credit card reader 130. In an attract mode, the video display 110 may depict payment information as shown in screen shot 405-1 in FIG. 4A. In one embodiment, the sensor 190 (or a separate sensor) identifies movements proximate the fortune telling device 100 and enters an attract mode whereby the fortune telling device 100 displays a fortune telling routine (which may or may not use a celebrity) comprising a video and audio file intended to persuade a user to have their fortune read. For example, the attract mode fortune telling routine may comprise a video file of a traditional-appearing fortune teller which appears on video display 110 and an audio file presented over speakers 180 announcing "Come Over and Have Your Fortune Read by a Celebrity, No Time Like the Present to Learn Your Future."

Figure 4A:
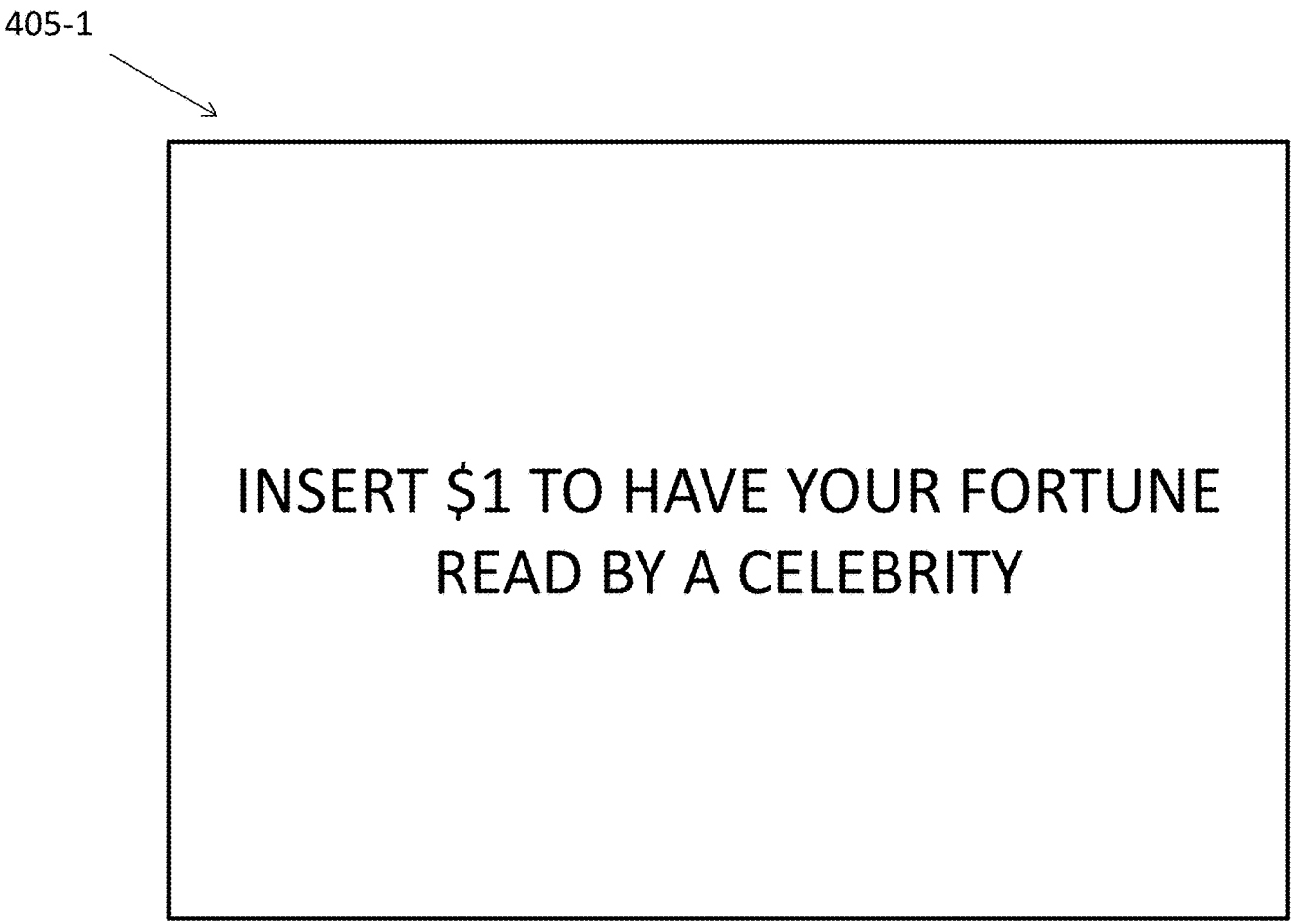
FIGS. 4A-4D illustrate a series of exemplary screen shots associated with one method of operating the fortune telling device according to the embodiments of the present invention.
Figure 4B:
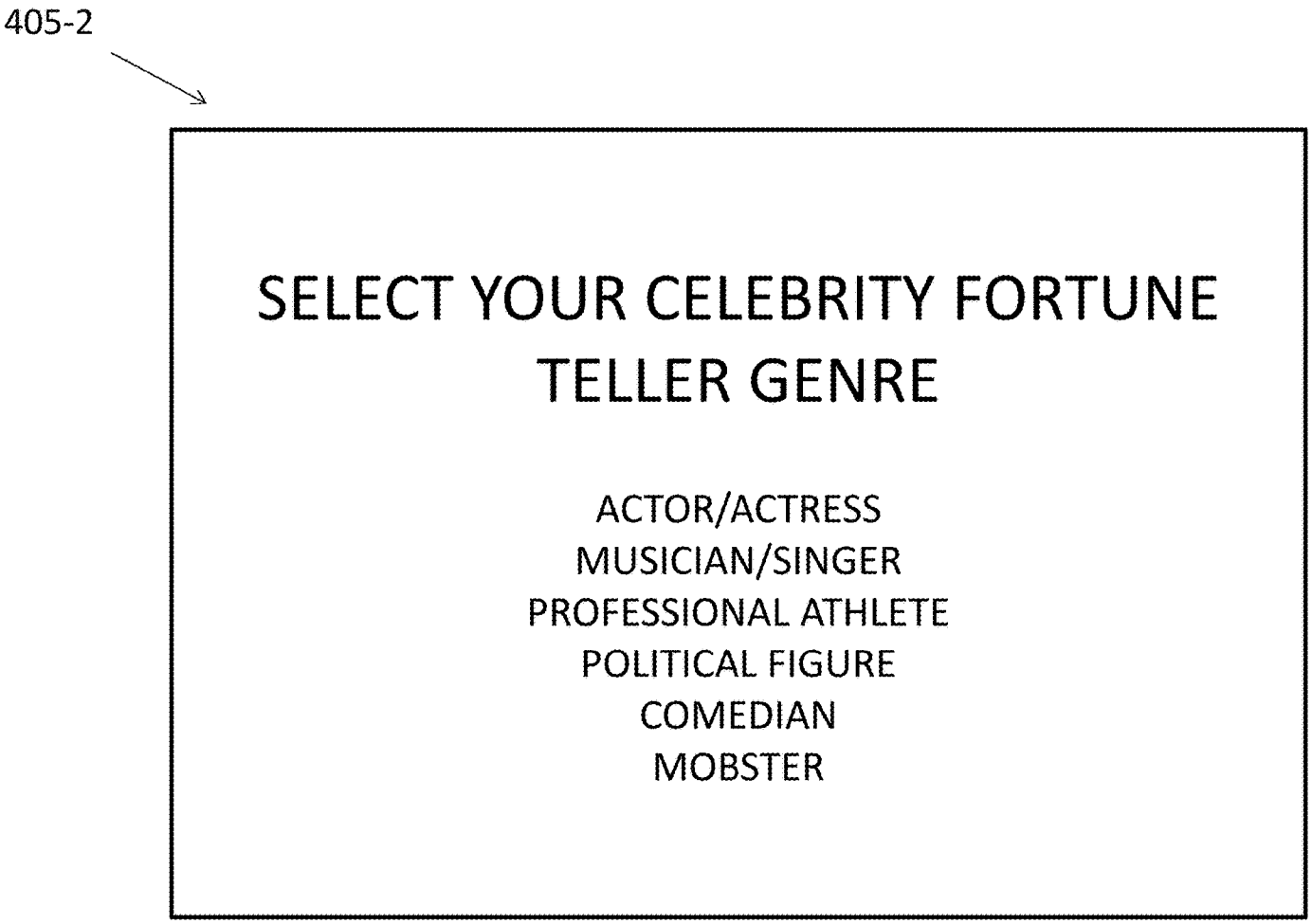
Figure 4C:
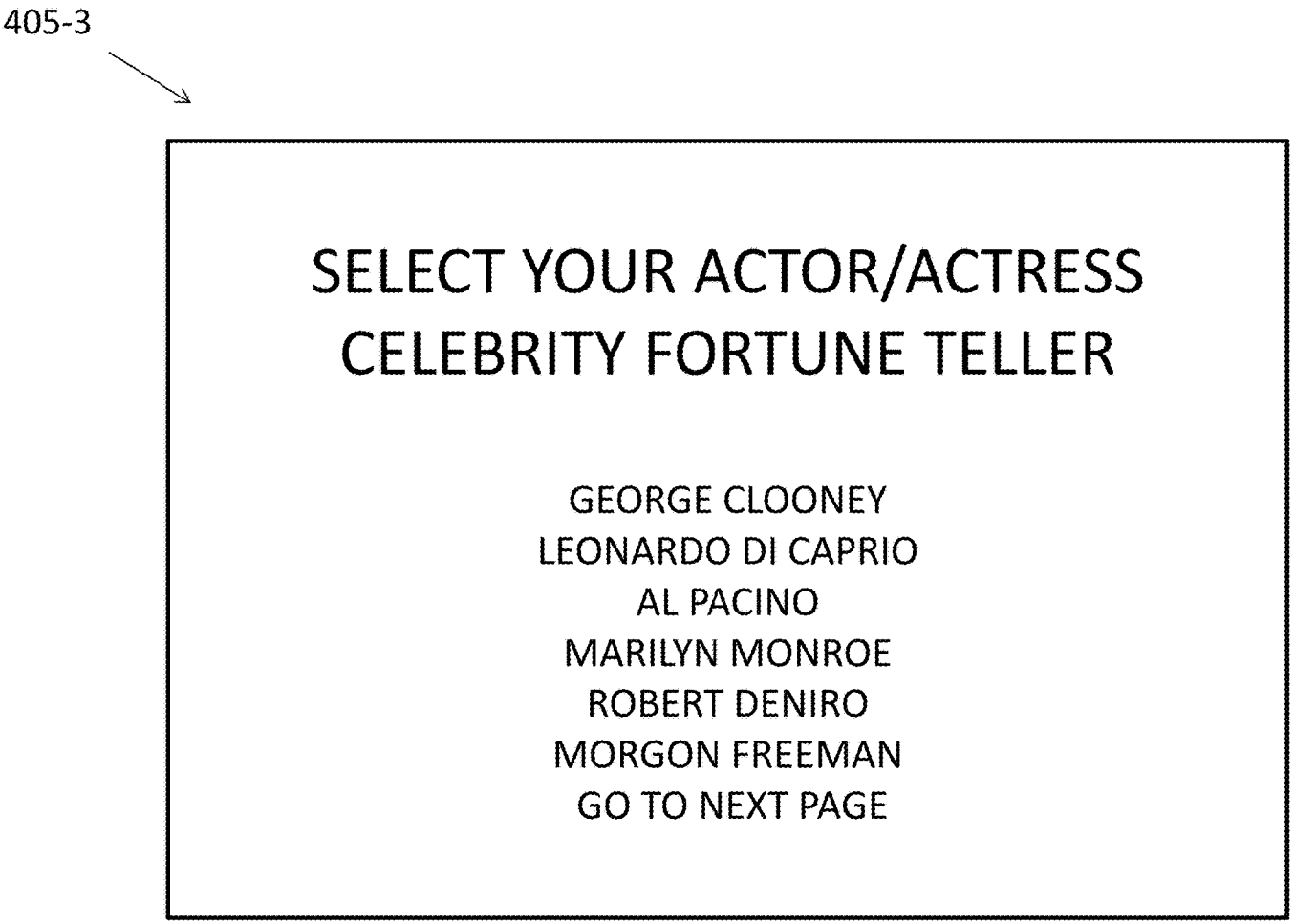
Figure 4D:
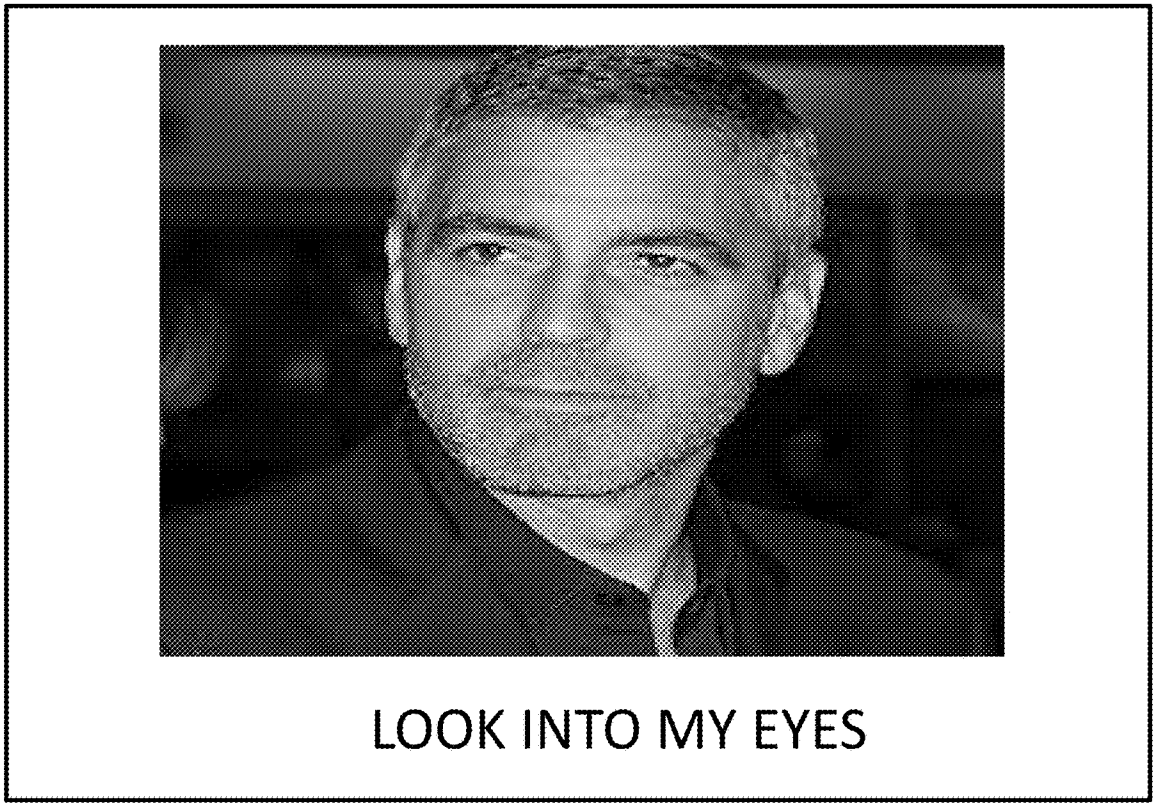

Upon receiving payment, at 310, the video display 110 presents a celebrity fortune telling genre selection as shown in screen shot 405-2 of FIG. 4B. The genres, as shown, include, but are not limited to, actor/actress, musician/singer, professional athlete, political figure, comedian and mobster. The user may select the desired genre using the touch screen or other available user interface 140. Upon receiving a genre selection, at 315, the video display 110 presents a list of celebrities included within the selected genre as shown in screen shot 405-3 of FIG. 4C. Upon receiving a celebrity selection, at 320, video and audio files associated with the selected celebrity are identified from the one or more databases 180-1 through 180-N. At 325, one of the video files and corresponding audio file associated with the selected celebrity is either randomly or chronologically selected. At 330, the randomly or chronologically selected video file and corresponding audio file is played over the video display 110 and speakers 180, respectively. Screen shot 405-4 of FIG. 4D shows an exemplary celebrity fortune teller and accompanying instructions. At 335, a souvenir memorandum of the fortune is printed by printer 135. The memorandum may include a summary of the told fortune commensurate with the fortune telling routine. In one embodiment, the printed memorandum may include a photo of the celebrity fortune teller to render the printed memorandum a keepsake.

In one specific example, the user picks Harry Houdini to read his or her fortune followed by a three stage fortune telling routine comprising: (i) an opening stage comprising an announcement by Harry Houdini; (ii) a fortune telling stage comprising the reading (e.g., you will be successful, have a great life, you will be successful in some new venture, but cautions you to watch out for strangers, etc.); and (iii) a closing stage comprising standard closing remarks and a promo for other celebrities and/or features (e.g., mock weddings) associated with the fortune telling device.

For living celebrities, the fortune telling routines may be pre-scripted and acted out by the subject celebrities. For celebrities having passed away, the fortune telling routines may be created using existing video footage and audio recording or celebrity impersonators may be used alone or in combination with the existing video footage and audio recordings. Celebrity impersonators may also be used in place of, or in combination with, living celebrities. Computer-generated imagery may also be used to create the celebrity personalities. In lieu of video footage, static images may be used as is with audio files played in the background or technology may be used to provide the static images with moving lips in sync with audio. For example, Martin Luther King's famous words "We shall overcome" can be used as a part of his fortune telling routine such that an audio file associated with a celebrity impersonator, computer-generated imagery or static image of MLK may play the following statement via speakers 180: "You shall overcome all of the obstacles in life to succeed."

Figure 5:
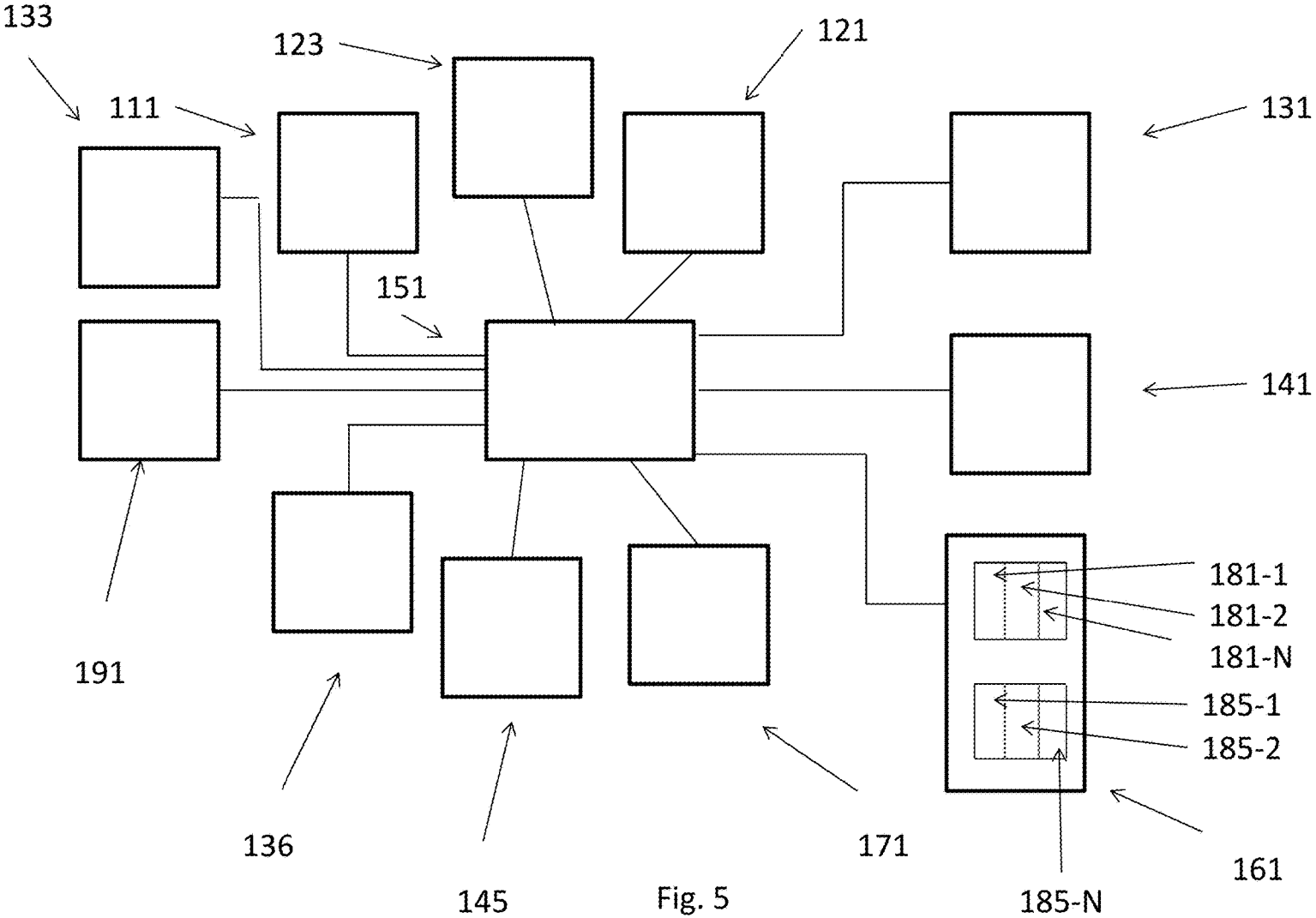
FIG. 5 illustrates a block diagram of a fortune telling device which can act as a mock wedding chapel according to the embodiments of the present invention.

In another embodiment, a fortune telling device 101 is used as a mock wedding chapel. In this embodiment, besides performing fortune telling functions, the fortune telling device 101 is configured to utilize a celebrity to perform a fictitious wedding of a couple. FIG. 5 shows a block diagram the fortune telling device 101 according to the embodiments of the present invention. The fortune telling device 101 includes a video display 111, bill validator 121, debit/credit card reader 131, printer 136, user interface 141, processor 151, memory 161 and speakers 171. In one embodiment, the user interface 141 is a touch screen video display while in other embodiments the user interface may be a button panel, joystick, track ball or similar article. The memory 161 manages one or more databases 181-1 through 181-N directed to fortune telling routines and one or more databases 185-1 through 185-N directed to mock wedding routines.

Figure 6:
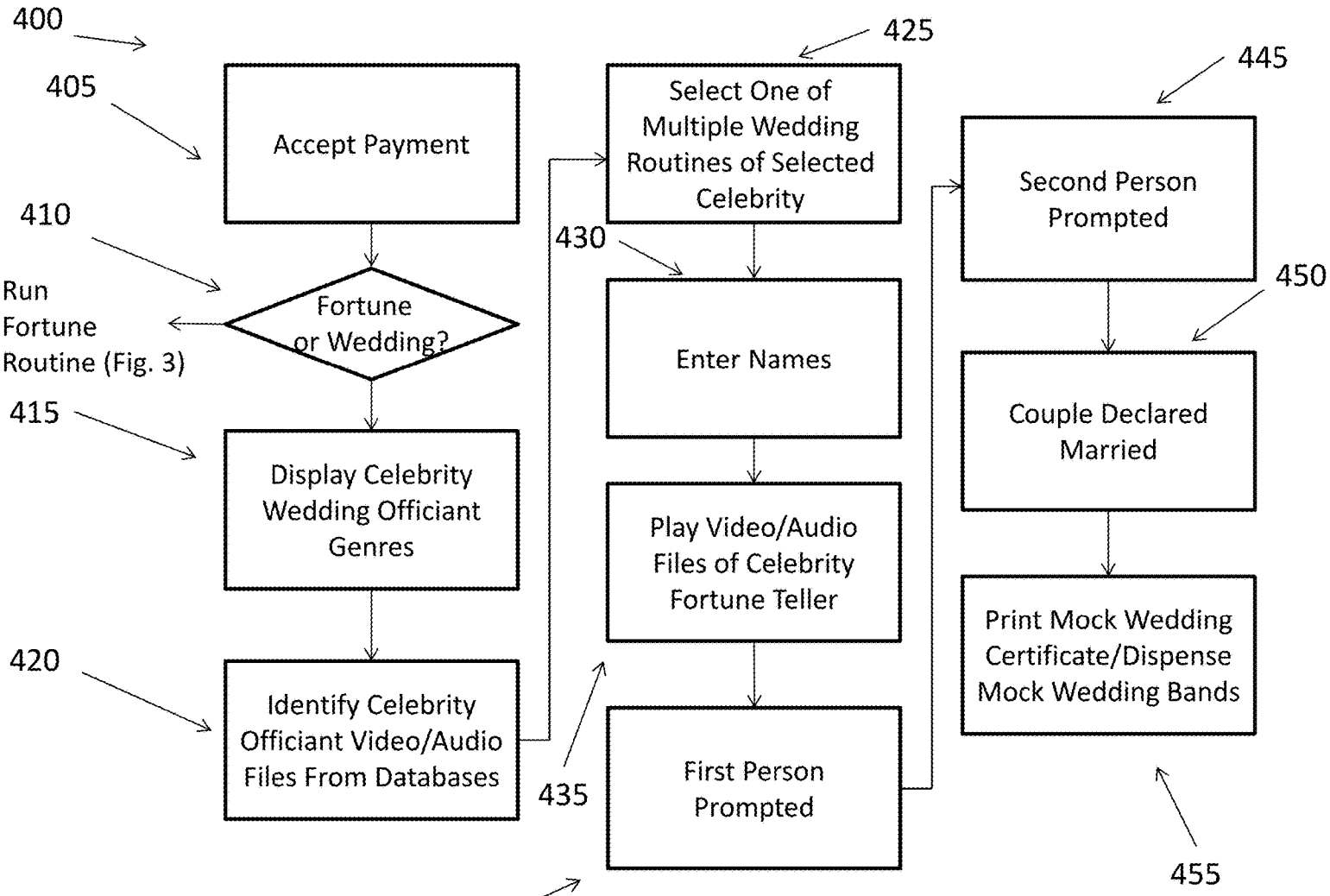
FIG. 6 illustrates a flow chart detailing another method of operating the fortune telling device according to the embodiments of the present invention.

FIG. 6 shows a flow chart 400 and FIGS. 7A-7H show various, exemplary screen shots 505-1 through 505-4 which together provide a detailed outline of operating the video fortune telling device 101 as a mock wedding chapel according to the embodiments of the present invention. At 405, a user makes a payment accepted by a fortune telling device 100 to have his or her fortune told by a celebrity or a mock wedding performed by a celebrity. The payment may be made by inserting currency or coupon into the bill validator 121 or using a debit/credit card inserted into the debit/credit card reader 131. In an attract mode, the video display 111 may depict payment information as shown in screen shot 505-1 in FIG. 7A. In one embodiment, the sensor 191 (or a separate sensor) identifies movements proximate the fortune telling device 101 and enters an attract mode whereby the fortune telling device 101 displays a fortune telling routine or mock wedding routine (which may or may not use a celebrity) comprising a video and audio file intended to persuade a user to have their fortune read. For example, the attract mode mock wedding routine may comprise a video file of a celebrity wedding officiant appearing on video display 111 and an audio file presented over speakers 181 announcing "Come Over and Marry Your Sweetheart—No Waiting."

Figure 7A:
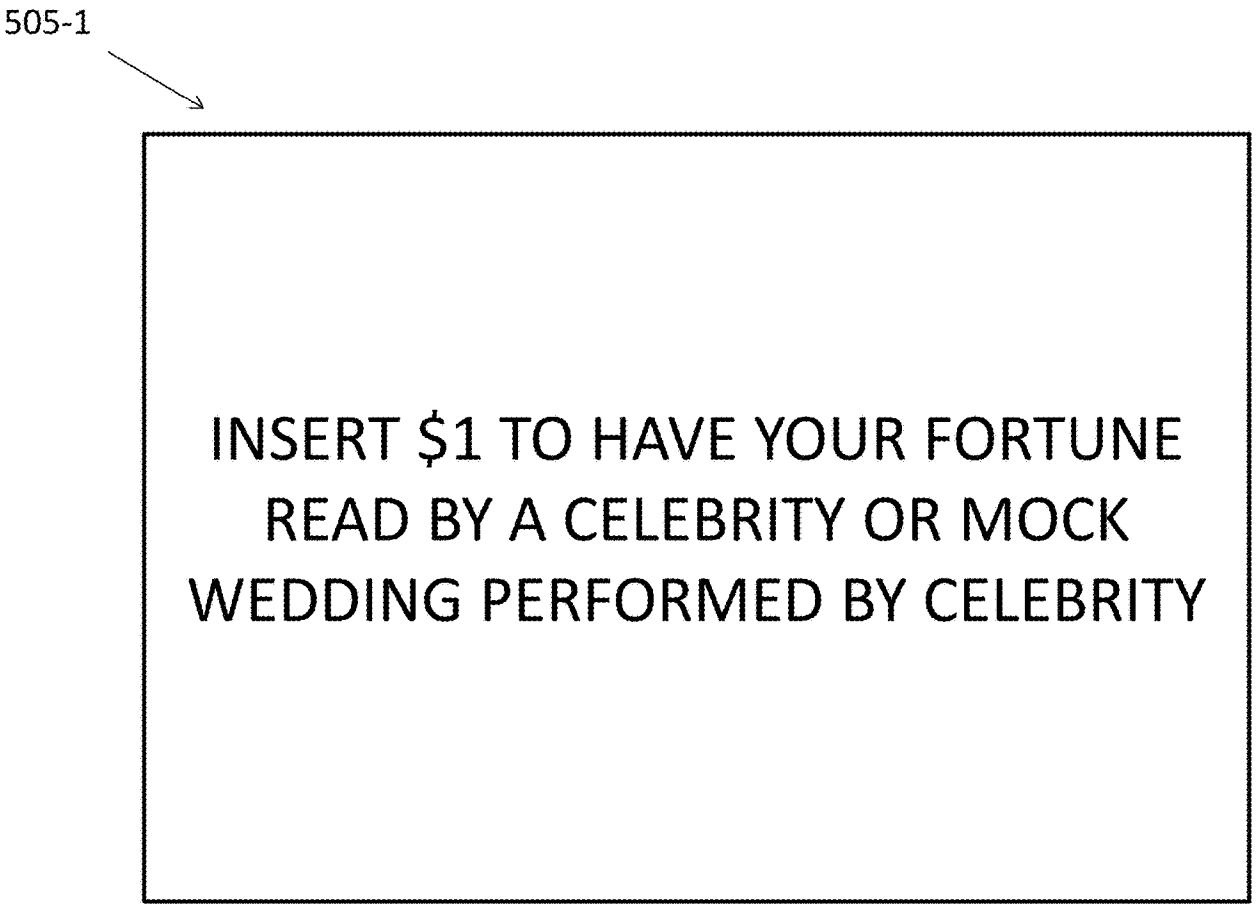
FIGS. 7A-7H illustrate a series of exemplary screen shots associated with another method of operating the fortune telling device according to the embodiments of the present invention.
Figure 7B:
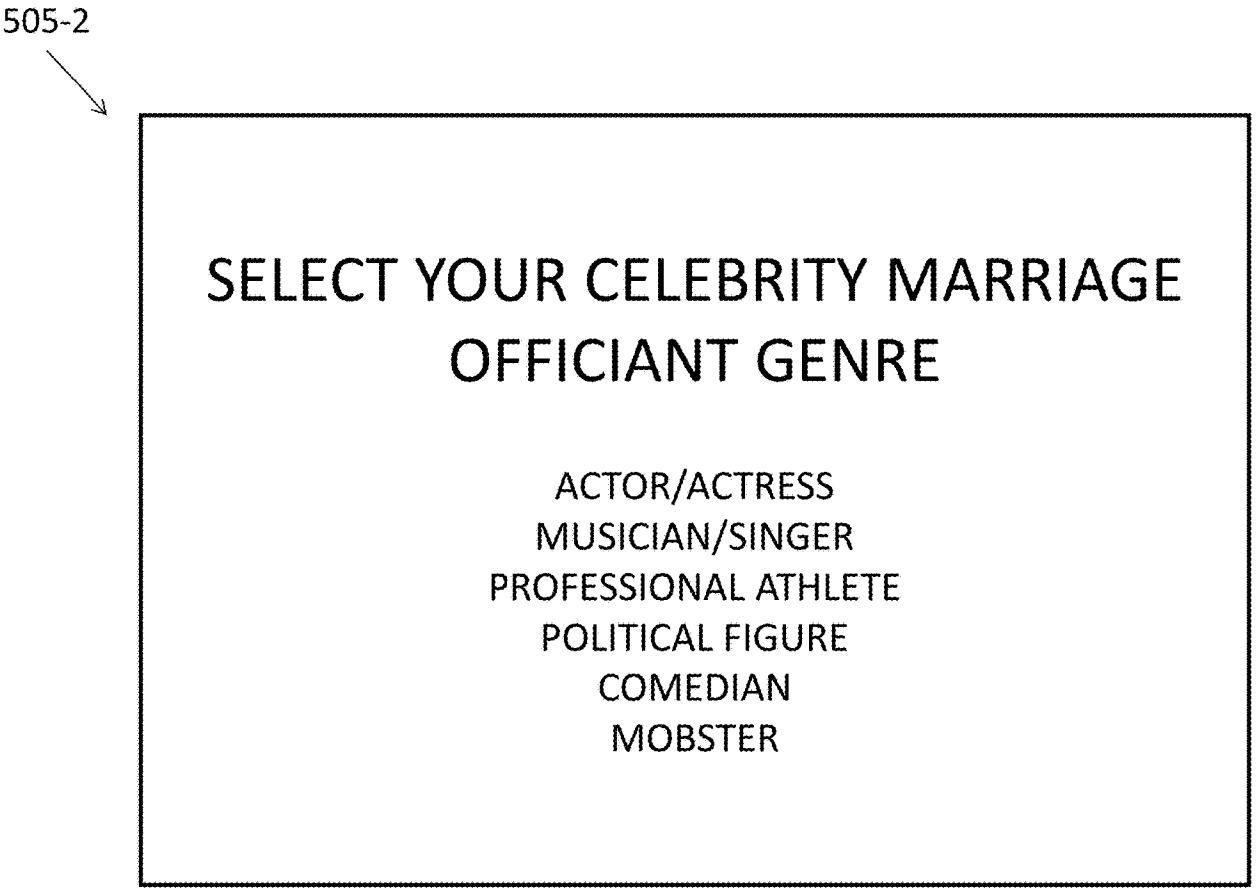
Figure 7C:
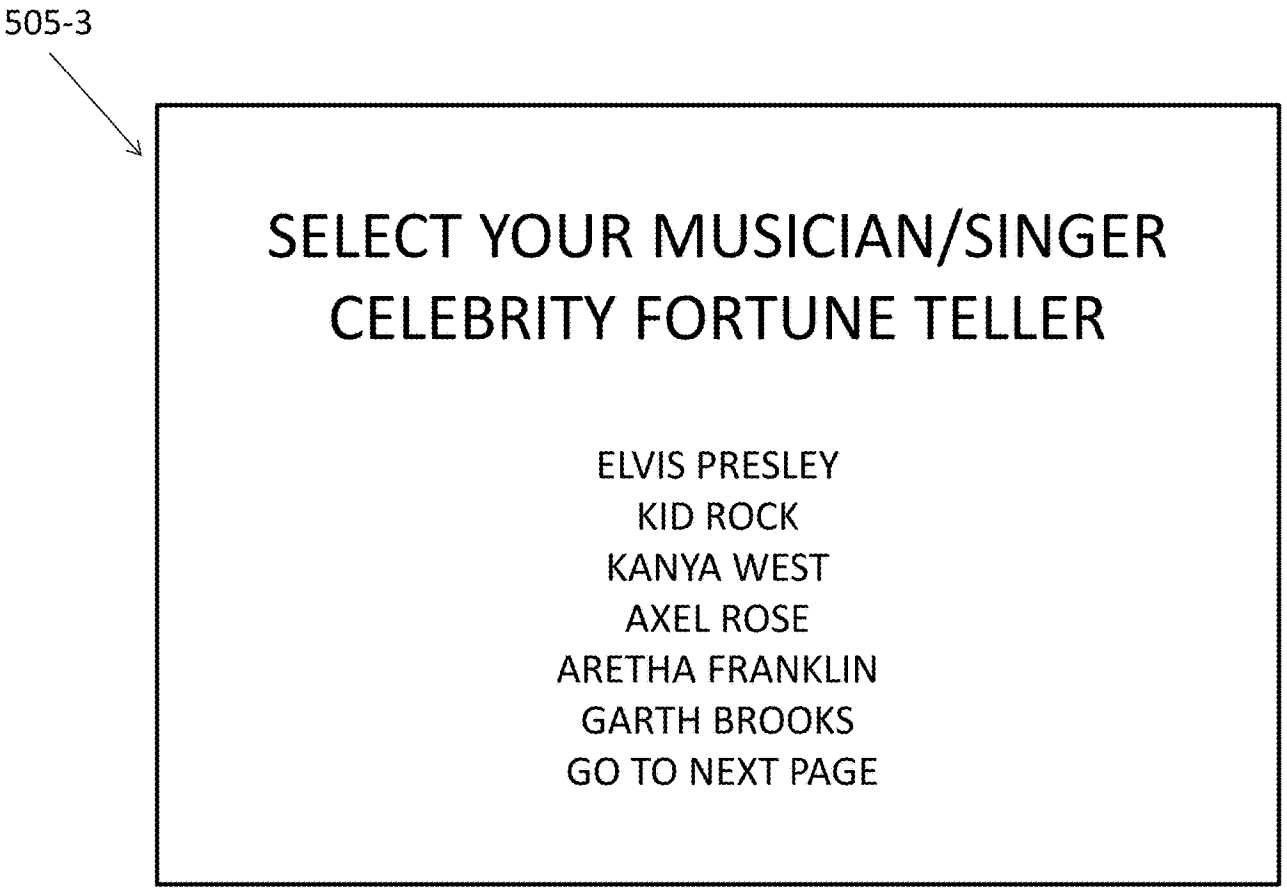
Figure 7D:
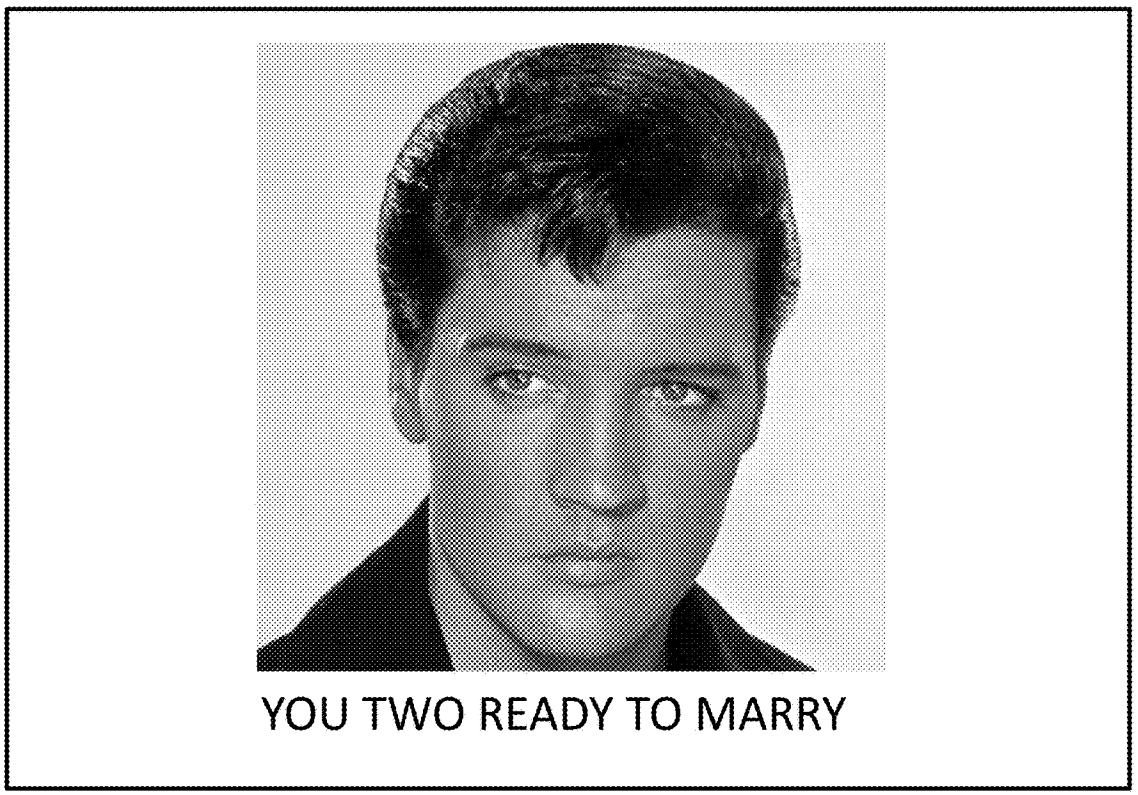
Figure 7E:
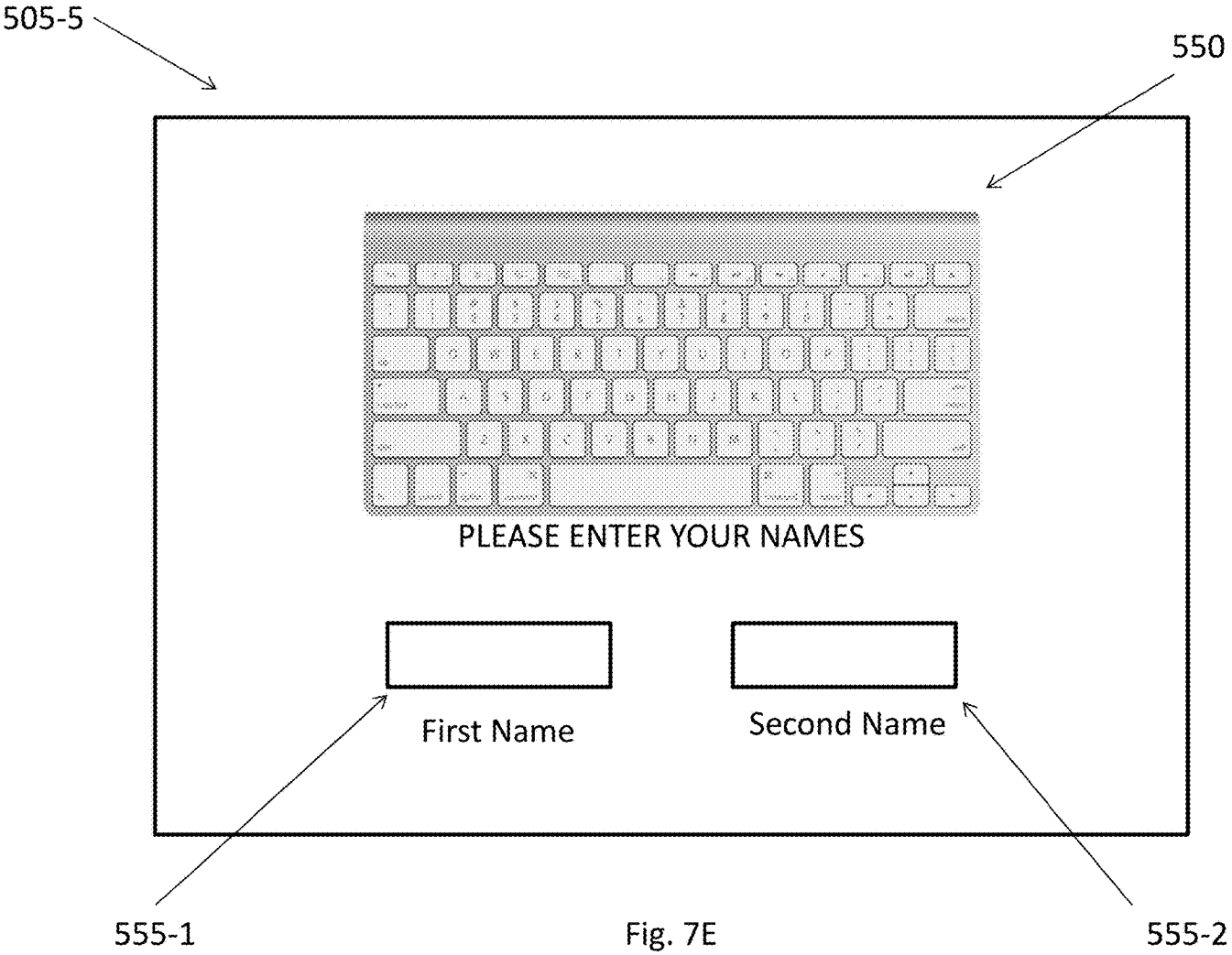
Figure 7F:
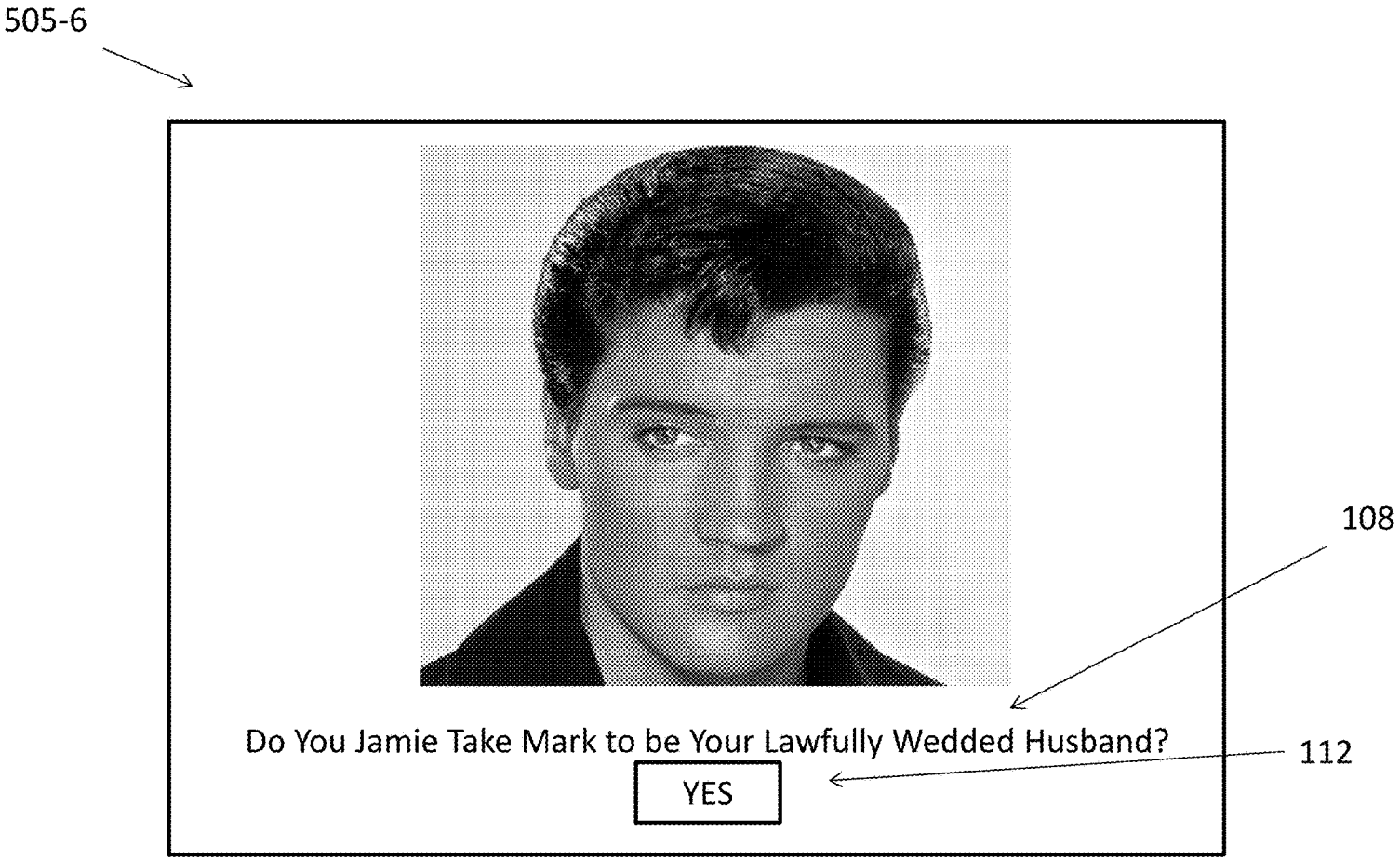
Figure 7G:
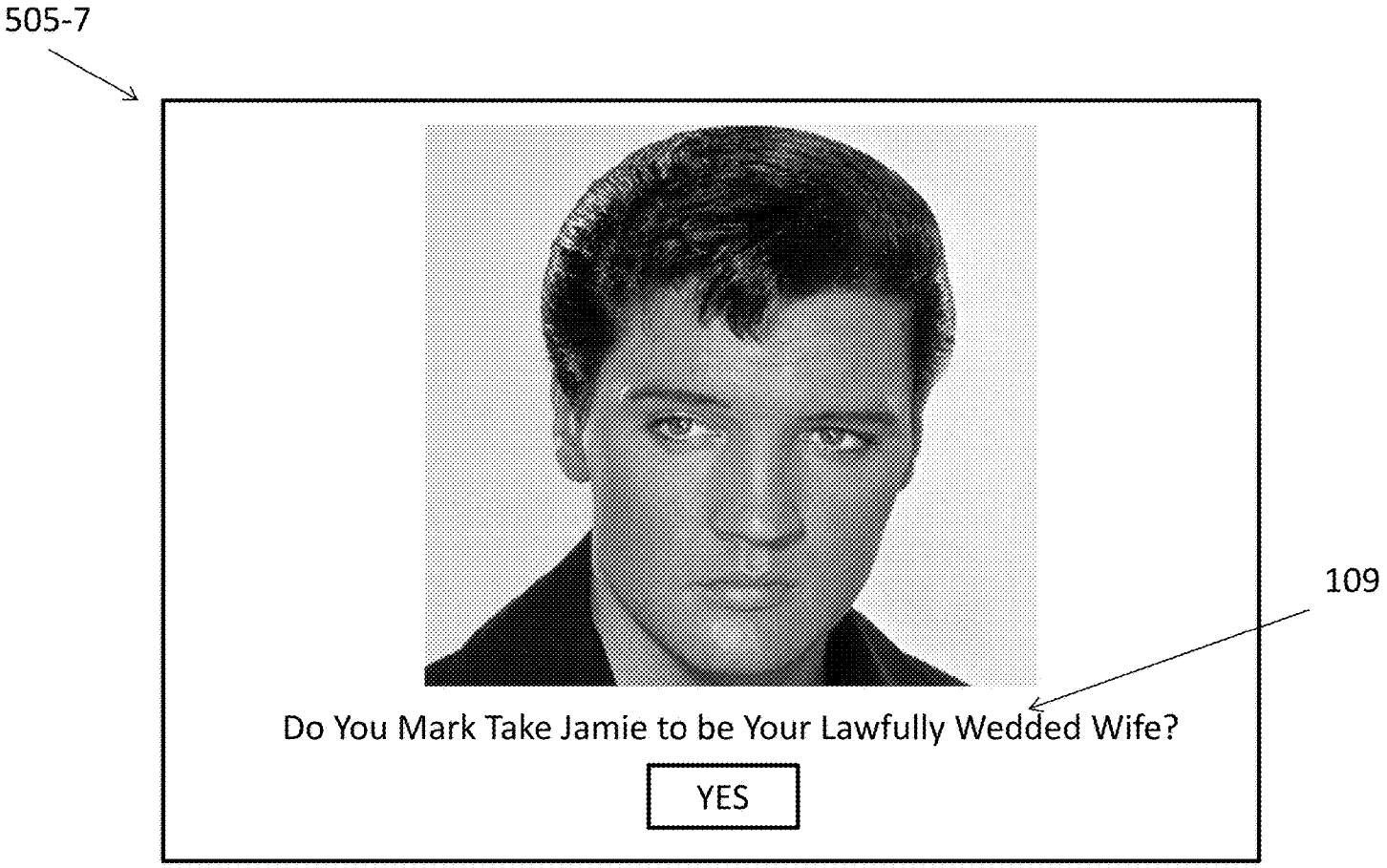
Figure 7H:
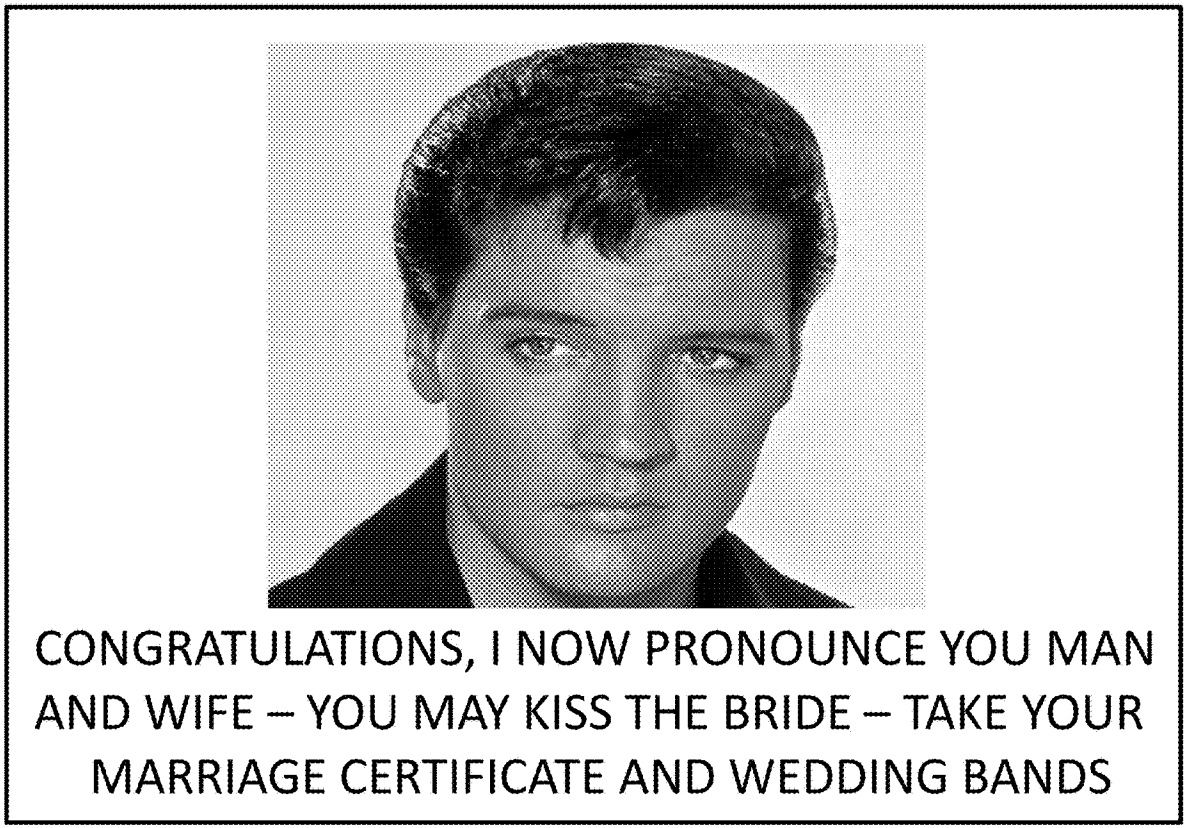

Upon receiving payment, at 410, the video display 111 presents a user with a celebrity fortune telling or mock wedding option. If the user selects the celebrity fortune telling option, flowchart 300 is followed. If the user selects mock wedding option, at 415, a celebrity wedding officiant genre selection is presented as shown in screen shot 505-2 of FIG. 7B. The genres, as shown, include, but are not limited to, actor/actress, musician/singer, professional athlete, political figure, comedian and mobster. The user may select the desired genre using the touch screen or other available user interface 141. Upon receiving a genre selection, at 420, the video display 111 presents a list of celebrities included within the selected genre as shown in screen shot 505-3 of FIG. 7C. Upon receiving a celebrity selection, at 420, video and audio files associated with the selected celebrity are identified from the one or more databases 181-1 through 181-N. At 425, one of the video and corresponding audio files is selected randomly or chronologically and the selected celebrity is presented on the video display 111, as shown in screen shot 505-4 of FIG. 7D, with an introductory message (e.g., You Two Ready to Marry). At 430, the user is prompted to enter the names of the persons to be fictitiously married. As shown in screen shot 505-5 of FIG. 7E, the video display 111 displays an interactive keyboard 550 allowing the user to enter the two names of the persons to be married in input boxes 555-1, 555-2 via the touch screen interface 141. At 435, the randomly or chronologically selected video file and corresponding audio file is played over the video display 111 and speakers 171, respectively. At 440, a first person being fictitiously married is asked to confirm his or her desire to marry. For example, an audio file may be played via speakers 171 announcing "Do you Jamie take Mark to be your lawfully wedded Husband?" and/or it may be presented, as shown in screen shot 505-6 of FIG. 7F, on video display 111 in the form of a question 108. Voice recognition software may evaluate an audio response or a user may touch response icon 112. Once as response has been input either via the touch screen interface 141 or audio microphone 145 or no response is forthcoming within a pre-established time period (e.g., 10 seconds), the flow chart 400 advances. At 445, a second person being fictitiously married is asked to confirm his or her desire to marry. For example, an audio file may be played via speakers 171 announcing "Do you Jamie take Mark to be your lawfully wedded Husband?" and/or it may be presented, as shown in screen shot 505-7 of FIG. 7G, on video display 111 in the form of a question 109. At 450, once a response has been input either via the touch screen interface 141 or audio microphone 145 or no response is forthcoming within a pre-established time period (e.g., 10 seconds), the flow chart 400 advances. At 455, the fortune telling device 101 declares the couple married and printer 137 prints a fictitious keepsake marriage certificate dispensed via a printer slot. Screen shot 505-8 of FIG. 7H shows a message 114 regarding the same.

Figure 8:
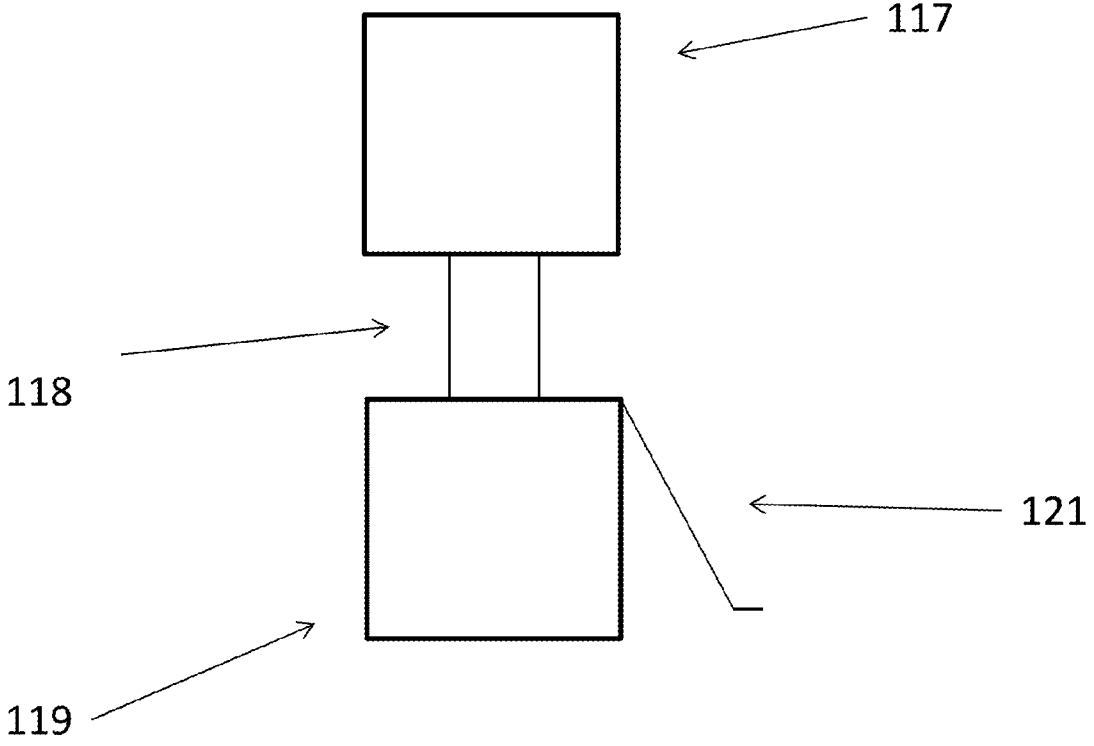
FIG. 8 illustrates a mechanism for dispensing mock wedding rings according to the embodiments of the present invention.

In one embodiment, as shown in FIG. 8, a pair of inexpensive, mock wedding bands is dispensed from a storage compartment 117 via a chute 118 into an accessible compartment 119 from which the user may lift a door 121 and collect the dispensed mock, wedding bands. The mock wedding bands may be contained in a sealed bag. The sealed bags of wedding bands may be maintained by a motorized carousal or other mechanical device controlled by the processor 151.

Figure 9A:
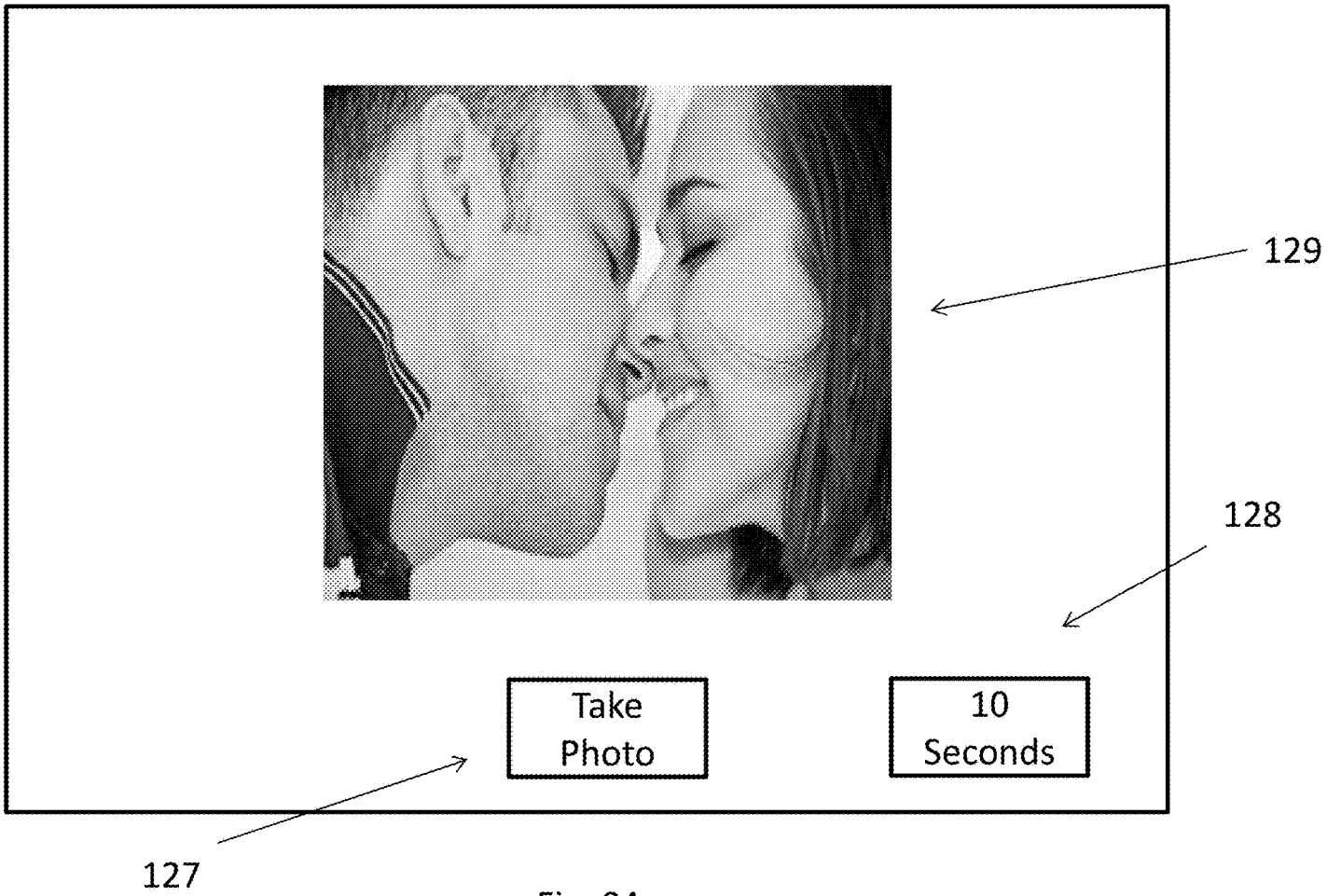
FIGS. 9A and 9B illustrates a fortune telling device incorporating a camera according to the embodiments of the present invention.
Figure 9B:
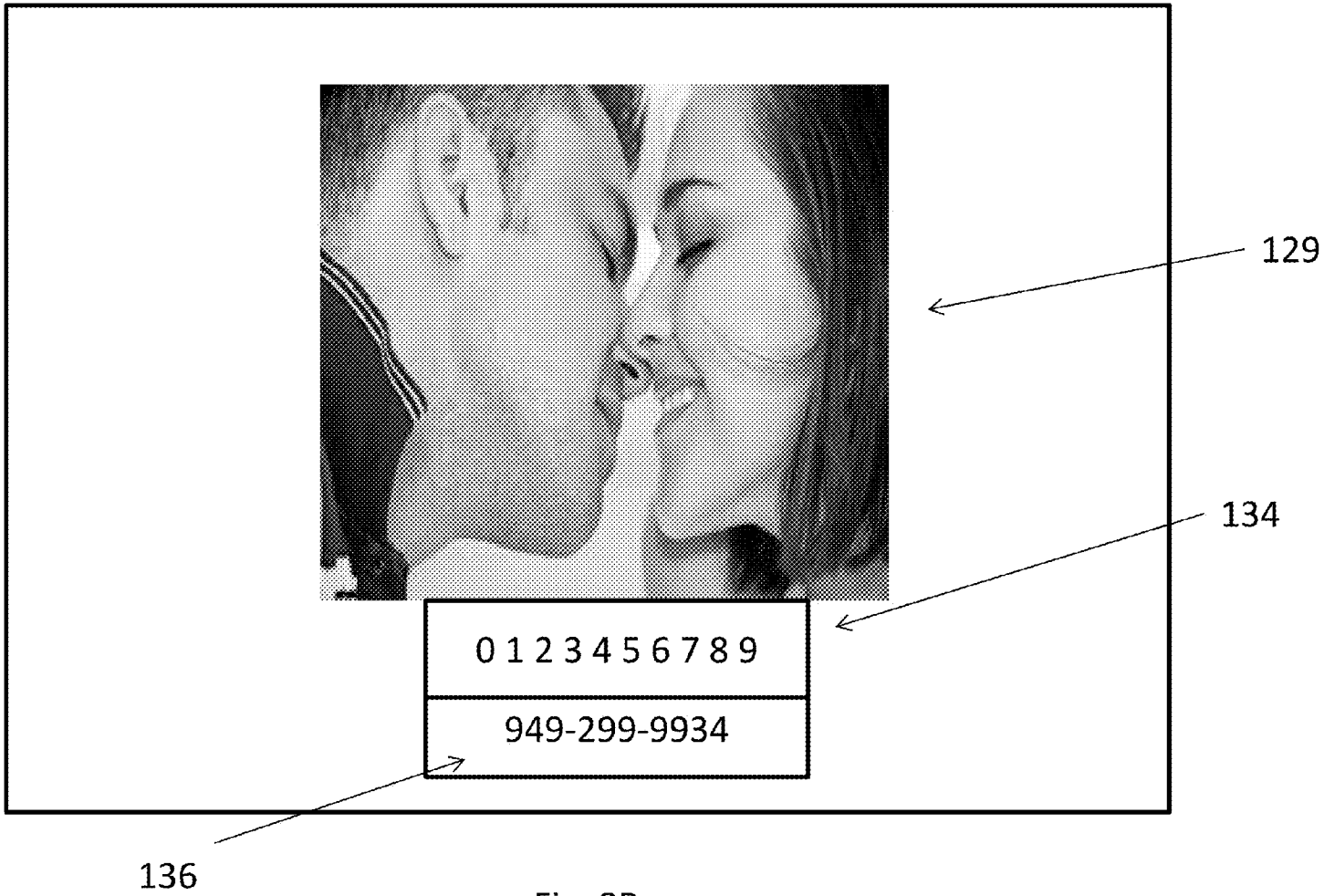

In one embodiment, the fortune telling device 101 includes a camera 123 which is configured to take a photo of the wedding couple which can be wirelessly transmitted to a mobile device of the user. Taking the photo may be triggered by a photo icon 127 as shown in FIG. 9A. A timer 128 allows the couple to arrange themselves for the photo and window 129 allows the couple to confirm they are in the correct location for the photo. A transmitter 133 is configured to send the photo a mobile device as identified by the user via touch screen number grid 134 and window 136 as shown in FIG. 9B.

Like above relative to fortune telling routines, the celebrity wedding routines may be created using living celebrities, celebrity personalities, computer-generated imagery and/or static images.

Figure 10:
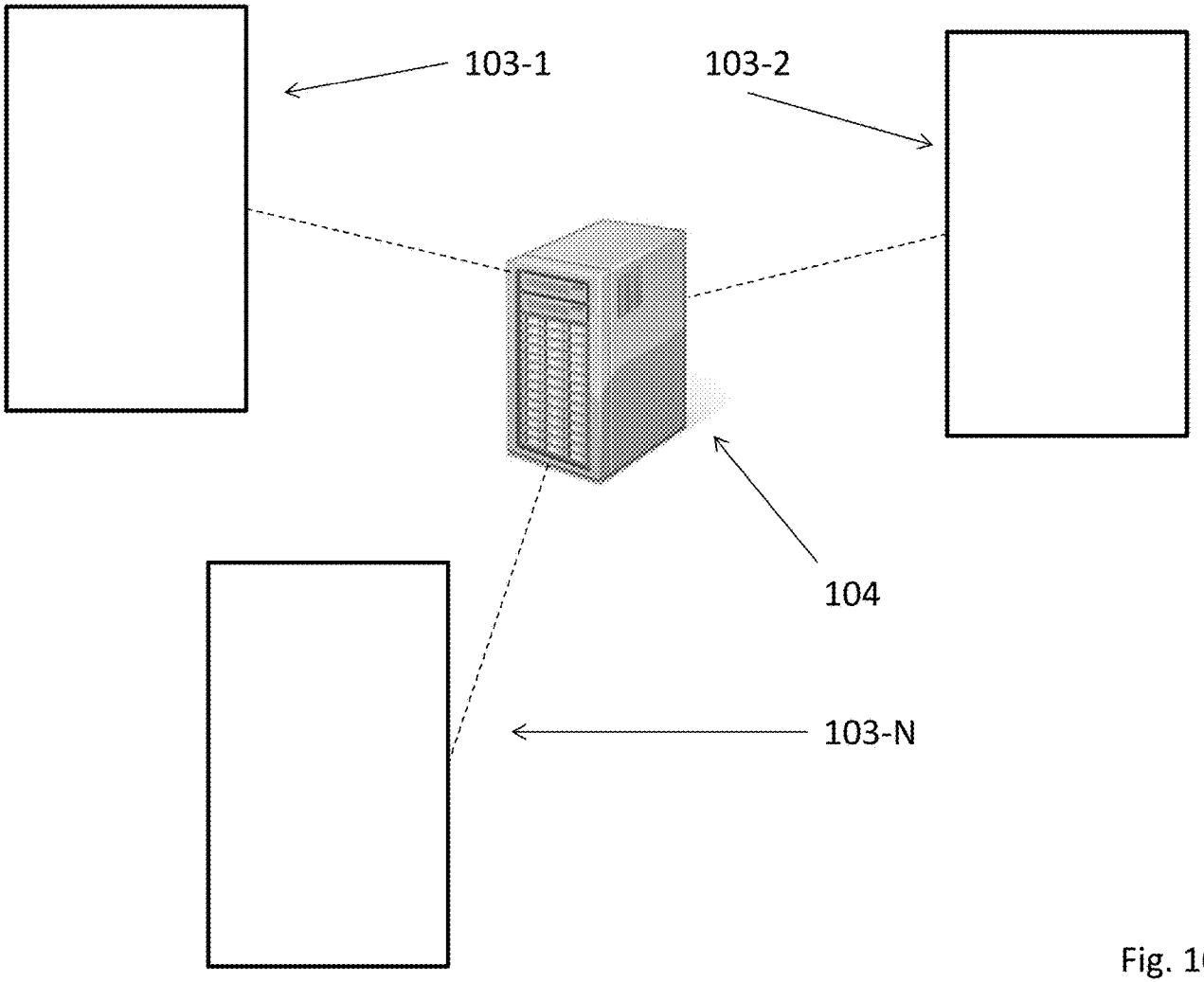
FIG. 10 illustrates a network comprising multiple fortune telling devices in communication with a central data server according to the embodiments of the present invention.

While the fortune telling devices 100, 101 are described above with video and audio files stored locally, in another embodiment, as shown in FIG. 10, the video and audio files may be stored remotely on, for example, one or more central computers or servers 104 accessible via an Internet-style connection. In such an embodiment, multiple fortune telling devices 103-1 through 103-N may be linked to the server 104 creating a network from which all fortune telling devices 103-1 through 103-N may access video and audio files from the central server 103 which are then transmitted via cables/wires or wirelessly to the subject fortune telling device 103-1 through 103-N for play. Processing power may be at the server 104, gaming devices 103-1 through 103-N or a combination thereof.

Although the invention has been described in detail with reference to several embodiments, additional variations and modifications exist within the scope and spirit of the invention as described and defined in the following claims.

I claim:

1. A fortune telling device, comprising:

a housing containing at least a video display, user interface, speakers, printer, memory and processor;

one or more video and audio files maintained by said memory, said video and audio files comprising celebrity video clips and corresponding audio clips related to a plurality of fortune telling routines;

a sensor to identify attributes of users near said housing; and wherein said processor is configured to: (i) responsive to sensor readings of user attributes, automatically select and play on said video display and over said speakers a fortune telling routine from said plurality of fortune telling routines, said fortune telling routine comprising a video file and corresponding audio file; and (ii) cause said printer to print a fortune telling certificate commensurate with said played fortune telling routine thereby providing a tangible record of said played fortune telling routine.

2. The device of claim 1 wherein said processor is further configured to present to device users selectable celebrity genres on said video display.

3. The device of claim 1 wherein said processor is further configured to present to device users selectable celebrities from said genres on said video display.

4. The device of claim 1 wherein said celebrity video files are created using one or more of the following:

(i) living celebrities;

(ii) video footage of celebrities;

(iii) static images of celebrities; and (iv) computer-generated imagery.

5. A mock wedding device comprising:

a housing containing at least an accessible compartment, dispenser, video display, user interface, speakers, printer, memory and processor;

one or more video and audio files maintained by said memory, said video and audio files comprising celebrity video clips and corresponding audio clips related to a plurality of mock wedding routines; and wherein, responsive to a user interacting with the mock wedding device via said user interface, said processor is configured to: (i) play on said video display and over said speakers a mock wedding routine from said plurality of mock wedding routines, said mock wedding routines comprising a video file and corresponding audio file; (ii) cause said printer to print a mock wedding certificate commensurate with a played mock wedding routine; and (iii) activate said dispenser to dispense mock wedding bands via said accessible compartment thereby providing a tangible record of said played mock wedding routine.

6. The device of claim 5 wherein said processor is further configured to present to device users selectable celebrity genres on said video display.

7. The device of claim 5 wherein said processor is further configured to present to device users selectable celebrities from said genres on said video display.

8. The device of claim 5 wherein said celebrity video files are created using one or more of the following:

(i) living celebrities;

(ii) video footage of celebrities;

(iii) static images of celebrities; and (iv) computer-generated imagery.

9. The device of claim 5 further comprising a camera configured to take a mock wedding photograph and transmitter configured to wirelessly transmit a digital version of said mock wedding photograph to a mobile device.

10. The device of claim 5 further comprising means for receiving names of users participating in the mock wedding.

11. The device of claim 5 further comprising a microphone.

12. A system, comprising:

a central computer having memory;

a plurality of fortune telling devices in communication with said central computer, each fortune telling device comprising a housing containing at least a video display, user interface, speakers and printer;

one or more video and audio files maintained by said memory, said video and audio files comprising celebrity video clips and corresponding audio clips related to a plurality of fortune telling routines;

sensors to identify attributes of users near a subject fortune telling device; and one or more processors configured to: (i) responsive to sensor readings of user attributes, automatically select and play on a video display and over said speakers of at least one of said fortune telling devices a fortune telling routine from said plurality of fortune telling routines, said fortune telling routine comprising a video file and corresponding audio file; and (ii) cause a printer of said at least one of said plurality of fortune telling devices to print a fortune telling certificate commensurate with said played fortune telling routine thereby providing a tangible record of said played fortune telling routine.

13. The system of claim 12 further comprising:

one or more video and audio files comprising celebrity video clips and corresponding audio clips related to mock wedding routines.

14. The system of claim 13 further comprising:

responsive to a user interacting with the mock wedding device via said user interface, said processor is configured to: (i) play on said video display and over said speakers a mock wedding routine from said plurality of mock wedding routines, said mock wedding routines comprising a video file and corresponding audio file; (ii) cause said printer to print a mock wedding certificate commensurate with a played mock wedding routine; and (iii) activate said dispenser to dispense mock wedding bands via said accessible compartment thereby providing a tangible record of said played mock wedding routine.

15. The system of claim 13 wherein said celebrity video files are created using one or more of the following:

(i) living celebrities;

(ii) video footage of celebrities;

(iii) static images of celebrities; and (iv) computer-generated imagery.

16. The system of claim 12 wherein said one or more processors are further configured to present on a video display of any of said plurality of fortune telling devices selectable celebrity genres.

17. The system of claim 12 wherein said one or more processors are further configured to present on a video display of any of said plurality of fortune telling devices selectable celebrities from said genres.

18. The system of claim 12 wherein said celebrity video files are created using one or more of the following:

(i) living celebrities;

(ii) video footage of celebrities;

(iii) static images of celebrities; and (iv) computer-generated imagery.

* * * * *